US008887742B2

(12) United States Patent
Eiermann et al.

(10) Patent No.: US 8,887,742 B2
(45) Date of Patent: Nov. 18, 2014

(54) DISHWASHER COMPRISING A DRYING APPARATUS

(75) Inventors: Rüdiger Eiermann, Syrgenstein (DE); Helmut Jerg, Giengen (DE); Hans-Peter Nannt, Gerstetten (DE)

(73) Assignee: BSH Bosch und Siemens Hausgaraete GmbH, Munich (DE)

( * ) Notice: Subject to any disclaimer, the term of this patent is extended or adjusted under 35 U.S.C. 154(b) by 1901 days.

(21) Appl. No.: 10/574,714

(22) PCT Filed: Oct. 6, 2004

(86) PCT No.: PCT/EP2004/011174

§ 371 (c)(1),
(2), (4) Date: Mar. 5, 2007

(87) PCT Pub. No.: WO2005/034716

PCT Pub. Date: Apr. 21, 2005

(65) Prior Publication Data

US 2007/0261721 A1 Nov. 15, 2007

(30) Foreign Application Priority Data

Oct. 6, 2003 (DE) ..... 103 46 304

(51) Int. Cl.
*A47L 15/48* (2006.01)

(52) U.S. Cl.
CPC ..... *A47L 15/483* (2013.01)
USPC ..... 134/107; 134/56 D

(58) Field of Classification Search
USPC ..... 134/107
See application file for complete search history.

(56) References Cited

U.S. PATENT DOCUMENTS

| | | | | |
|---|---|---|---|---|
| 3,068,877 | A * | 12/1962 | Jacobs | 134/99.1 |
| 2002/0193265 | A1 | 12/2002 | Perron et al. | |
| 2003/0140517 | A1 | 7/2003 | Schmid | |

FOREIGN PATENT DOCUMENTS

| | | |
|---|---|---|
| DE | 7110279 | 7/1973 |
| DE | 128108 | 11/1977 |
| DE | 31 13 430 | 10/1982 |
| DE | 100 22 088 | 1/2001 |
| DE | 100 13 415 | 9/2001 |
| DE | 100 13 416 | 9/2001 |
| DE | 100 24 892 | 11/2001 |

(Continued)

OTHER PUBLICATIONS

International Search Report for PCT/EP 2004/011174.

*Primary Examiner* — Michael Barr
*Assistant Examiner* — Jason Riggleman
(74) *Attorney, Agent, or Firm* — James E. Howard; Andre Pallapies

(57) ABSTRACT

A drying apparatus that allows the wet washed dishes located in the washing container to be dried quickly from an economic and hygienic point of view is provided. The drying apparatus for drying washed dishes is disposed inside a dishwasher and circulates exclusively the air located in a washing container of the dishwasher. The drying apparatus is provided with a suction port for introducing the air from the washing container into the drying apparatus, a blow-out port for discharging the air from the drying apparatus into the washing container, a conveying section between the suction port and the blow-out port, and a fan for conveying the air from the suction port to the blow-out port via the conveying section with the conveying section having a condensing section with at least one wall operable as a condensing surface upon which the humidity contained in the air condenses.

23 Claims, 2 Drawing Sheets

(56) References Cited

FOREIGN PATENT DOCUMENTS

| | | | | |
|---|---|---|---|---|
| EP | 0 978 250 | | 2/2000 | |
| EP | 1 090 580 | | 4/2001 | |
| EP | 1 344 487 | | 9/2003 | |
| FR | 2 491 319 | | 4/1982 | |
| FR | 2 491 322 | | 4/1982 | |
| FR | 2491319 | * | 4/1982 | ..... A47L 15/48 |
| FR | 2491322 | * | 4/1982 | ..... A47L 15/48 |

* cited by examiner

DISHWASHER COMPRISING A DRYING APPARATUS

BACKGROUND OF THE INVENTION

The invention relates to a dishwasher comprising a drying device for drying washed dishes.

BRIEF SUMMARY OF THE INVENTION

During the rinsing operation in a dishwasher, one or more rinsing process are usually carried out to clean the items for washing located in the dishwasher. To enhance the cleaning effect the rinsing liquid is heated by means of electrical heaters before or during a rinsing process. The last rinsing process is usually followed by a clear rinsing phase followed by a drying process to dry the washed items. Various methods are known for drying washed items in a dishwasher.

For example, the washed items can be dried by own-heat drying using a heat exchanger by heating the rinsing liquid for the clear rinsing and thus the washed items which have undergone a hot clear rinse are dried by themselves by the self-heat of the washed items which has thus built up during the drying process. In order to achieve this own-heat drying, the clear rinsing liquid is heated to a certain temperature in the heat exchanger and applied to the washed items by means of spraying devices. As a result of the relatively high temperature of the clear rinsing liquid of usually 65° C. to 70° C., it is achieved that a sufficiently large quantity of heat is transferred to the washed items so that water adhering to said washed items evaporates as a result of the heat stored in said washed items.

In a further known method for heating or drying the washed items in dishwashers, a separate heat source, e.g. a hot air fan, is used to heat the moist air mixture during the drying process so that the air in the washing container can absorb a larger quantity of water.

A disadvantage in the methods for heating or drying washed items in dishwashers described above according to the prior art is that the heating of the rinsing liquid is associated with a high energy requirement and the thermal energy required for each heating phase must be produced anew by means of electrical heating elements. The known methods also have the disadvantage that the heating of the clear-rinsing liquid and the drying process are themselves associated with a high energy requirement and the thermal energy required is lost after the drying process.

In order to guide the moist air mixture located in the washing container out of said washing container as fast as possible to thus accelerate the drying phase, it is further known in the prior art to convey the moist air mixture from the washing container into the external atmosphere by means of a suitable fan. A disadvantage of these drying devices is that the moist air mixture can result in growth of mould in the rooms or can be perceived as disturbing by the user.

In a further drying device in the prior art external air is passed into the washing container and thus improves the drying performance. In this drying device it has proved to be disadvantageous that the introduction of external air is not suitable from the hygiene point of view and the supply of external air always involves some escape of air located in the washing container.

It is thus the object of the invention to provide a drying device which allows the wet washed dished located in the washing container to be dried quickly from an economic and hygienic point of view.

Provided in the dishwasher according to the invention is a drying device for drying washed dishes, wherein the drying device is disposed inside the dishwasher and exclusively circulates the air located in a washing container of the dishwasher. The drying devices comprises a suction port for introducing the air from the washing container into the drying device, a blow-out port for discharging the air from the drying device into the washing container, a conveying section between the suction port and the blow-out port and a fan for conveying the air from the suction port to the blow-out port via the conveying section, wherein the conveying section encompasses a condensing section in which at least one wall of the conveying section is embodied as a condensing surface on which the moisture contained in the air is deposited.

The principle forming the basis of the present invention thus consists in reducing the air moisture present in the washing container during the drying process by removing the moisture from the air located in the washing container during its passage through the drying device. A dishwasher with a system for drying washed items according to the invention thus has the advantage that both the drying time and also the energy expenditure required for drying the washed items is reduced.

The dishwasher according to the invention also has the advantage that no moisture-laden air is released to the surrounding atmosphere, thereby avoiding harmful influences on the furniture such as the formation of mould, for example. Furthermore, the washed items do not come in contact with the external air during drying so that a high standard of hygiene is ensured. In addition to the advantages of energy saving, as a result of the reduction in the temperature of the clear-rinsing liquid, the loading influences on the washed items are lower so that the risk of hairline cracks in ceramic crockery or earthenware vessels is reduced for example.

The aforesaid principle is based on the fact that the condensing surface has a lower temperature than the air located in the washing container. In a preferred embodiment of the dishwasher according to the invention, the condensing surface is in heat-conducting contact with an outer wall of the dishwasher. For this purpose that wall of the conveying section adjacent to the outer wall of the dishwasher is constructed as the condensing surface. Since the outer wall of the dishwasher generally consists of a metal housing, the housing of the dishwasher is especially well suited as a cooling surface. In this way good heat transfer from the condensing surface to an outer wall of the dishwasher is achieved.

During the manufacture of a dishwasher, the housing is generally assembled in one of the last working steps when the washing container has already been connected to all the relevant components. The drying device is therefore already arranged on the washing container when the housing is mounted around the washing container. In order to ensure a direct connection between the condensing surface and the outer wall of the dishwasher without an interposed air gap and therefore good heat conduction to the housing of the dishwasher, the condensing surface is preferably made of a flexible material. As soon as the air from the washing container is conveyed by the fan through the conveying section of the drying device, the flexible wall of the conveying section constructed as a condensing surface can expand outwards and come to rest against the outer wall of the dishwasher. For this purpose, the condensing surface is preferably in the form of a film of plastic or metal, especially of aluminium. Whereas a plastic film has the advantage of flexibly absorbing even point loads as a result of its expandability, a metal film has a high thermal conductivity.

In a further embodiment of the present invention, the drying device is substantially thermally insulated with respect to the washing container so that the conveying section and especially the condensing section stay as cool as possible in relation to the interior of the washing container. As a result, the largest possible temperature difference can be achieved between the air fed into the drying device from the washing container and the condensing section and thus the highest possible condensation effect.

More appropriately, the condensing section has at least one mixing vane projecting into the interior of the conveying section which causes turbulence of the air flowing through the condensing section. As a result, the residence time of the air in the condensing section is increased and contact between the air and the condensing surface is intensified, which promotes the condensing effect described above.

The condensing effect is further increased if the suction port of the drying device is arranged in the upper area of the washing container and the blow-out port of the drying device is arranged in the lower area of the washing container. Since the moist warm air remains in the upper area of the washing container, the arrangement of the suction port in the upper area of the washing container has the result that the air from the area of the washing container is conveyed into the drying device where the highest air humidity exists. The arrangement of the blow-out port in the lower area of the washing container promotes a circulatory movement of the air through the washing container and the drying device.

More appropriately the drying device has a discharge system by which means the water deposited in the condensing section is drained off. In this case, the water deposited in the drying device can be passed into the sump of the dishwasher, for example or conveyed via the discharge pump from the dishwasher.

In the conveying section of the drying device, a heating device is preferably provided directly before the blow-out port which heats the air passing by before it enters into the washing container. The heating device is constructed as a heating coil, for example, which is disposed on the inner wall of the conveying section. The air can thereby be heated before it re-enters the washing container in order to give the air a higher capacity for absorbing moisture, which accelerates the drying process. After the air has absorbed the moisture from the washed items, it is conveyed by the fan through the suction port back into the drying device. As the air flows through the condensing section, moisture is extracted and on passing through the heating device, the air is heated again and the cycle is thus closed.

In a further embodiment of the present invention, the fan is arranged after the condensing section in relation to the direction of air flow. Since the moisture has at least partly been removed from the air in the condensing section, the arrangement of the fan after the condensing section in relation to the direction of air flow has the advantage that the fan is loaded with the lowest possible air moisture. More appropriately, both the fan and also the heating device are connected to a program control of the dishwasher so that the fan and accordingly the heating device are controlled according to the status of the rinsing program.

As a result of the circulation of the air and the removal of the moisture from the air in the dishwasher according to the invention, a homogeneous heat distribution is achieved inside the drying air and also a uniform flow through the washing container, which results in a higher efficiency and therefore better energy values for operation of the dishwasher according to the invention.

The conveying section is advantageously arranged in a side wall or in the door of the dishwasher. It is also possible to arrange the conveying section in the rear area of the washing container but the side wall and the door are especially suitable because openings are already present in these areas, such as for example the expansion shaft to compensate for pressure peaks in the washing container. On the other hand, the side walls and the door of a dishwasher generally have an exposed position and thus provide efficient heat transfer.

BRIEF DESCRIPTION OF THE DRAWINGS

The present invention is explained in detail using a preferred embodiment with reference to the appended drawings. In the figures.

DETAILED DESCRIPTION OF EXEMPLARY EMBODIMENTS OF THE PRESENT INVENTION

Figure 1:
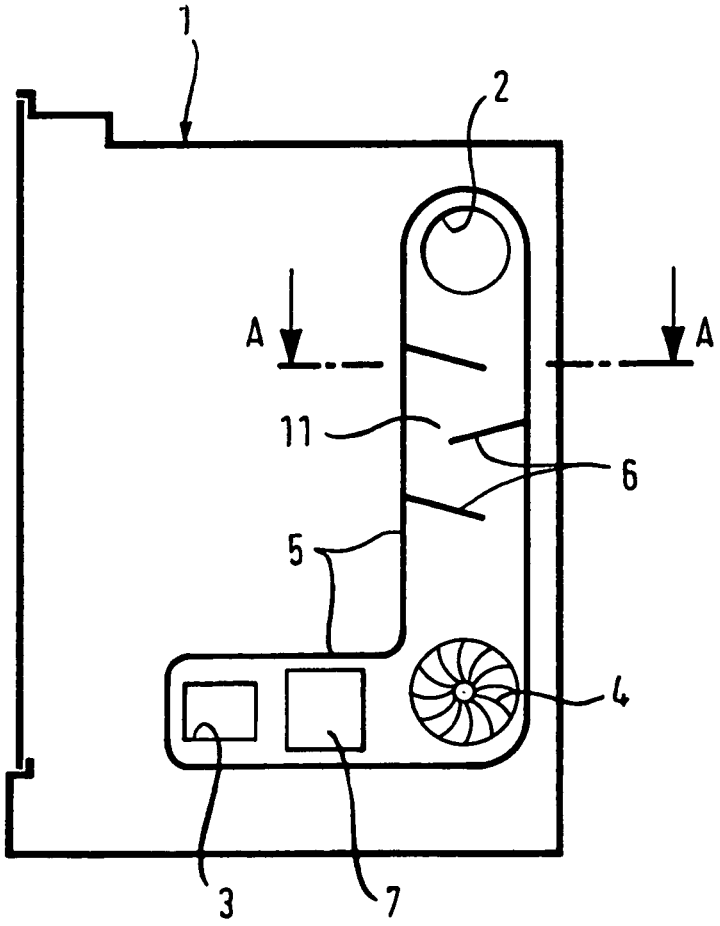
FIG. 1 is a sectional view through a dishwasher according to the invention with a drying device accommodated in the side wall.

The dishwasher according to the invention according to FIG. 1 comprises a washing container 1 with a drying device in the side wall, a suction port 2 for introducing air from the washing container 1 into the drying device, a blow-out port 3 for discharging the air from the drying device into the washing container 1 and a conveying section 11 between the suction port 2 and the blow-out port 3 and a fan 4 for conveying the air from the suction port 2 to the blow-out port 3 via the conveying section 5. The conveying section 5 encompasses a condensing section 11 in which at least one wall of the conveying section 5 in which moisture from the air is deposited since the condensing section 11 has a lower temperature than the moist warm air from the washing container 1. The condensing section 11 is additionally provided with a number of mixing vanes 6 which project into the interior of the conveying section and thereby cause turbulence of the air flowing through the condensing section 11, which promotes the condensation effect.

The suction port 2 is located in the upper area of the washing container 1 and the blow-out port 3 is located in the lower area of the washing container 1. The moist warm air is thereby conveyed from the upper area of the washing container 1 where the highest air humidity exists, into the drying device. As a result of the arrangement of the blow-out port 3 in the lower area of the washing container 1, a circulatory movement of the air through the washing container and the drying device is established.

During the drying phase the fan 2 which is connected to a control unit (not shown) is activated and sucks moist air through the suction port 2 from the washing container 1. As the moist air is conveyed further through the conveying section 5, the moist air passes the condensing section 11 where the moisture from the air is deposited at least partly. The air is then heated at a heating device 7 and is thus capable of absorbing a larger quantity of moisture. The now heated air from which moisture has been removed is passed into the washing container 1 through the outlet opening 3 at the end of the conveying section and can now be distributed to dry the moist washed items. As a result of the circulating flow thus established, rapid and homogeneous drying behaviour is achieved inside the washing container 1.

Figure 2:
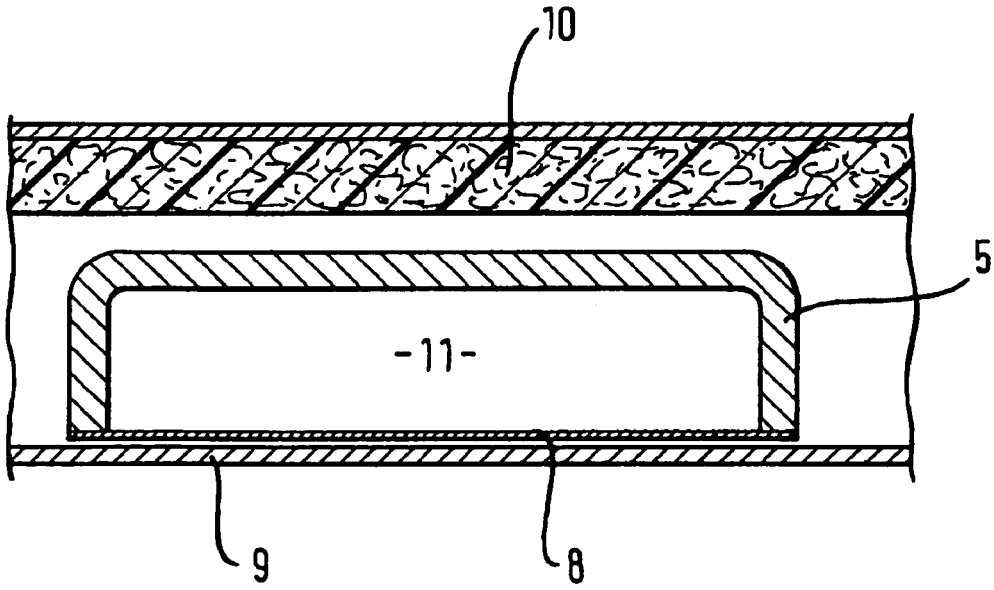
FIG. 2 is a sectional view through the drying device shown in FIG. 1.

FIG. 2 shows a sectional view along the plane defined by the reference symbol A-A in FIG. 1 through the drying device shown in FIG. 1. It can be seen that the conveying channel 5 has a condensing surface 8 in the area of the condensing section 11, which is directly adjacent to the outer wall 9 of the dishwasher. On the opposing side the conveying channel 5 is separated from the washing container 1 by a heat-insulating layer 10. The conveying section 5 is at least partly constructed as a condensing section 11, where the wall of the conveying section 5 adjacent to the outer wall 9 of the dishwasher (not shown) serves as the condensing surface 8.

Whereas the conveying channel 5 is thermally insulated from the washing container 1, the condensing surface 8 of the drying device is therefore in heating-conducting contact with the outer wall 9 of the dishwasher and is held at a temperature level approximately corresponding to room temperature. Since the outer walls 9 of the dishwasher generally consist of metal, these are especially well suited as cooling surfaces. In this way, good heat transfer is ensured from the condensing surface 8 to the outer wall 9 of the dishwasher and then to the environment. Consequently, the condensing surface 8 has a lower temperature during drying than the moist warm air originating from the washing container 1, thus producing the condensation effect.

In order to ensure that a good contact always exists between the condensing surface 8 and the outer wall 9 of the dishwasher and thus good heat conduction to the housing of the dishwasher, the condensing surface 8 is made of a flexible material. As soon as the air from the washing container 1 is conveyed by the fan 4 through the conveying section 5 of the drying device, the condensing surface 8 of the condensing section 11 embodied as a flexible wall can expand outwards and come to rest against the outer wall 9 of the dishwasher. The condensing surface 8 is constructed as film, for example, which is made of plastic or metal, especially of aluminium.

Reference List

1 Washing container
2 Suction port
3 Blow-out port
4 Fan
5 Conveying section between suction port and blow-out port
6 Mixing vane
7 Heating device
8 Condensing surface or condensing film
9 Outer wall of dishwasher
10 Heat insulating layer between drying device and washing container
11 Condensing section
A-A Sectional plane of FIG. 2

The invention claimed is:

1. A dishwasher comprising:
a washing container;
an outer wall; and
a drying device connected in an air circulating manner with the washing container such that air is circulated from the washing container to the drying device and from the drying device to the washing container with the circulated air acting to dry items disposed in the washing container,
the drying device including:
a suction port for introducing the air from the washing container into the drying device,
a blow-out port for discharging the air from the drying device into the washing container,
a conveying section between the suction port and the blow-out port, and
means for effecting movement of air such that air that has been introduced into the drying device via the suction port is conveyed through the conveying section enroute to subsequent discharge of the air through the blow-out port,
the conveying section including a condensing section having at least one wall and the at least one wall of the conveying section operating as a condensing surface on which the moisture contained in the air is deposited when the air is conveyed through the conveying section,
wherein the condensing surface is in direct physical heat-conducting contact with the outer wall of the dishwasher when the air is conveyed through the conveying section,
wherein the condensing surface comprises:
a flexible condensing surface that expands, as a result of the air being conveyed through the conveying section, from a first position, in which a space separates the flexible condensing surface from the outer wall of the dishwasher, to a second position, in which the flexible condensing surface comes to rest against the outer wall such that the flexible condensing surface is in the direct physical heat-conducting contact with the outer wall when the air is conveyed through the conveying section.

2. The dishwasher according to claim 1, wherein the condensing surface is formed of a material comprising a film of metal having aluminum content.

3. The dishwasher according to claim 1, wherein the condensing section has at least one mixing vane projecting into the interior of the conveying section.

4. The dishwasher according to claim 1, wherein the drying device has a discharge system by which means the water deposited in the condensing section is drained off.

5. The dishwasher according to claim 1, and further comprising a heating device disposed downstream of the conveying section and upstream of the blow-out port relative to the direction of flow of air through the drying device for heating air before the air enters into the washing container after its passage through the drying device.

6. The dishwasher according to claim 1, wherein the means for effecting movement of air includes a fan disposed downstream of the condensing section in relation to the direction of flow of air through the drying device.

7. The dishwasher according to claim 6, and further comprising a heating device disposed downstream of the conveying section and upstream of the blow-out port relative to the direction of flow of air through the drying device for heating air before the air enters into the washing container after its passage through the drying device and a program control for controlling the operation of the fan and the heating device.

8. The dishwasher according to claim 1, wherein the suction port of the drying device is disposed in an upper area of the washing container and the blow-out port of the drying device is disposed in a lower area of the washing container.

9. The dishwasher according to claim 1, wherein the conveying section is disposed in a selected one of a side wall of the dishwasher and a door of the dishwasher.

10. The dishwasher of claim 1, wherein the flexible condensing surface comprises at least one of a flexible plastic film and a flexible metal film.

11. The dishwasher of claim 1, wherein the condensing section is substantially thermally insulated with respect to the washing container.

12. A dishwasher comprising:
a washing container;
an outer wall; and
a drying device connected in an air circulating manner with the washing container such that air is circulated from the washing container to the drying device and from the drying device to the washing container with the circulated air acting to dry items disposed in the washing container,
the drying device including:
a suction port for introducing the air from the washing container into the drying device,
a blow-out port for discharging the air from the drying device into the washing container,
a conveying section between the suction port and the blow-out port, and
means for effecting movement of air such that air that has been introduced into the drying device via the suction port is conveyed through the conveying section enroute to subsequent discharge of the air through the blow-out port,
the conveying section including a condensing section having at least one wall and the at least one wall of the conveying section operating as a condensing surface on which the moisture contained in the air is deposited when the air is conveyed through the conveying section,
wherein the condensing surface is in direct physical heat-conducting contact with the outer wall of the dishwasher when the air is conveyed through the conveying section,
wherein the condensing section is substantially thermally insulated with respect to the washing container.

13. A dishwasher comprising:
an outer housing wall;
a washing container within the outer housing wall; and
a drying device connected in an air circulating manner with the washing container such that air is circulated from the washing container to the drying device and from the drying device to the washing container with the circulated air acting to dry items disposed in the washing container,
the drying device including:
a suction port for introducing the air from the washing container into the drying device,
a blow-out port for discharging the air from the drying device into the washing container,
a conveying section between the suction port and the blow-out port, and
a fan for effecting movement of the air such that the air that has been introduced into the drying device via the suction port is conveyed through the conveying section enroute to subsequent discharge of the air through the blow-out port,
wherein the conveying section includes:
a condensing section having a condensing surface on which the moisture contained in the air is deposited when the air is conveyed through the conveying section,
wherein the condensing section is disposed between the outer housing wall and a thermally insulated surface of the washing container, and
wherein the condensing surface directly contacts the outer wall of the dishwasher when the air is conveyed through the conveying section such that the outer wall conducts heat from the condensing surface.

14. The dishwasher of claim 13, wherein the condensing surface comprises:
a flexible condensing surface that expands, as a result of the air being conveyed through the conveying section, from a first position, in which a space separates the flexible condensing surface from the outer wall of the dishwasher, to a second position, in which the flexible condensing surface comes to rest against the outer wall such that the flexible condensing surface is in the direct physical heat-conducting contact with the outer wall when the air is conveyed through the conveying section.

15. The dishwasher of claim 14, wherein the flexible condensing surface comprises at least one of a flexible plastic film and a flexible metal film.

16. The dishwasher of claim 13, wherein the condensing section is substantially thermally insulated with respect to the washing container.

17. The dishwasher of claim 13, wherein the condensing section has at least one mixing vane projecting into the interior of the conveying section.

18. The dishwasher of claim 13, wherein the drying device has a discharge system by which means the water deposited in the condensing section is drained off.

19. The dishwasher of claim 13, further comprising a heating device disposed downstream of the conveying section and upstream of the blow-out port relative to the direction of flow of air through the drying device for heating air before the air enters into the washing container after its passage through the drying device.

20. The dishwasher of claim 13, wherein the means for effecting movement of air includes a fan disposed downstream of the condensing section in relation to the direction of flow of air through the drying device.

21. The dishwasher of claim 20, further comprising a heating device disposed downstream of the conveying section and upstream of the blow-out port relative to the direction of flow of air through the drying device for heating air before the air enters into the washing container after its passage through the drying device and a program control for controlling the operation of the fan and the heating device.

22. The dishwasher of claim 13, wherein the suction port of the drying device is disposed in an upper area of the washing container and the blow-out port of the drying device is disposed in a lower area of the washing container.

23. The dishwasher of claim 13, wherein the conveying section is disposed in a selected one of a side wall of the dishwasher and a door of the dishwasher.

* * * * *